United States Patent [19]

Nakamura

[11] 4,043,511

[45] Aug. 23, 1977

[54] SHOWER HEAD

[75] Inventor: Toshio Nakamura, Mishima, Japan

[73] Assignee: Sanyei Corporation, Tokyo, Japan

[21] Appl. No.: 705,354

[22] Filed: July 14, 1976

[51] Int. Cl.[2] ..... A62C 31/02

[52] U.S. Cl. ..... 239/394

[58] Field of Search ..... 239/383, 392, 394

[56] References Cited

U.S. PATENT DOCUMENTS

| | | | |
|---|---|---|---|
| 2,790,680 | 4/1957 | Rosholt | 239/394 |
| 3,998,390 | 12/1976 | Peterson | 239/394 |

*Primary Examiner*—Richard A. Schacher

*Attorney, Agent, or Firm*—Ostrolenk, Faber, Gerb & Soffen

[57] ABSTRACT

A multi-nozzle shower head having a housing secured to a holder and a nozzle section with a plurality of nozzles rotatably mounted on the housing. The housing and nozzle section each have a wall transverse to the flow of water. The housing wall has a water passage opening spaced from the center of rotation by the same distance as each of the plurality of nozzles so that only one nozzle may register therewith at a time. A separator plate is rotatable with the nozzle section but is mounted to bear against the side of the housing wall opposite that with respect to which the nozzle section rotates. This separator plate maintains the contact and parallel relation between the walls and supports the walls to prevent any tilt which might result in transverse leakage. In addition the nozzle section is gasketed to prevent transverse leakage within the nozzle section from nozzle to nozzle.

10 Claims, 9 Drawing Figures

SHOWER HEAD

BACKGROUND OF THE INVENTION

The present invention relates to shower heads and more particularly to a shower head having multiple nozzles each capable of being rotatably positioned to register with the source of the water supply so that the various nozzles might provide different types of streams of water.

The present invention contemplates the provision of a fine stream, a pulsator stream, a coarse stream and a wide angle stream. Each of the streams is created by a particular configuration of the nozzle and its interior. Each of the nozzles is mounted on a rotatable holder which in turn is carried by the shower head and may be positioned as previously pointed out to place the desired nozzle in position for registry with the source of water supply.

Various devices have been utilized to change the stream of a shower head. Most such devices have utilized a single nozzle where the configuration of the interior of the nozzle or a valve in the nozzle provides for variations which run the gamut from a wide angle fine mist to a straight high pressure spray. While such devices have previously been used quite successfully on hoses for irrigation, fire fighting or other purposes, such devices have not been fully successful in the case of shower heads since the variations available from a single nozzle are not always suitable for a shower.

Attempts have also been made to utilize multiple nozzles which could be exchanged, placed in position, inserted or removed. In these cases, particularly where the multiple nozzles were mounted on a single head, the leakage from nozzle to nozzle caused a substantial amount of water to be diverted to other nozzles producing leakage at those nozzles and around the shower head itself.

Since one of the desirable factors of a shower as compared to a bath is the utilization of about one-fifth the water that is used in a bath, then, when the shower head is used as a water conservation measure instead of a bath, the wasting of water by dripping or streams through adjacent nozzles diminishes the conservation capacity available.

DESCRIPTION OF THE PRESENT INVENTION

The present invention in order to solve the problems above set forth provides, as a primary object, a single shower head which may be mounted on the shower outlet and may be swiveled with respect thereto to the desired direction and in which a plurality of nozzles are mounted on a single plate or structure at the lower end of the shower head; this plate or structure may be rotated to register each of the selected nozzles with the source of water in the shower head while at the same time the access of water to the other nozzles is completely and definitely cut off so that the water does not drip or discharge through the other nozzles.

This and many other objects of the present invention will become apparent in the following description and drawings in which.

Figures 8, 9:
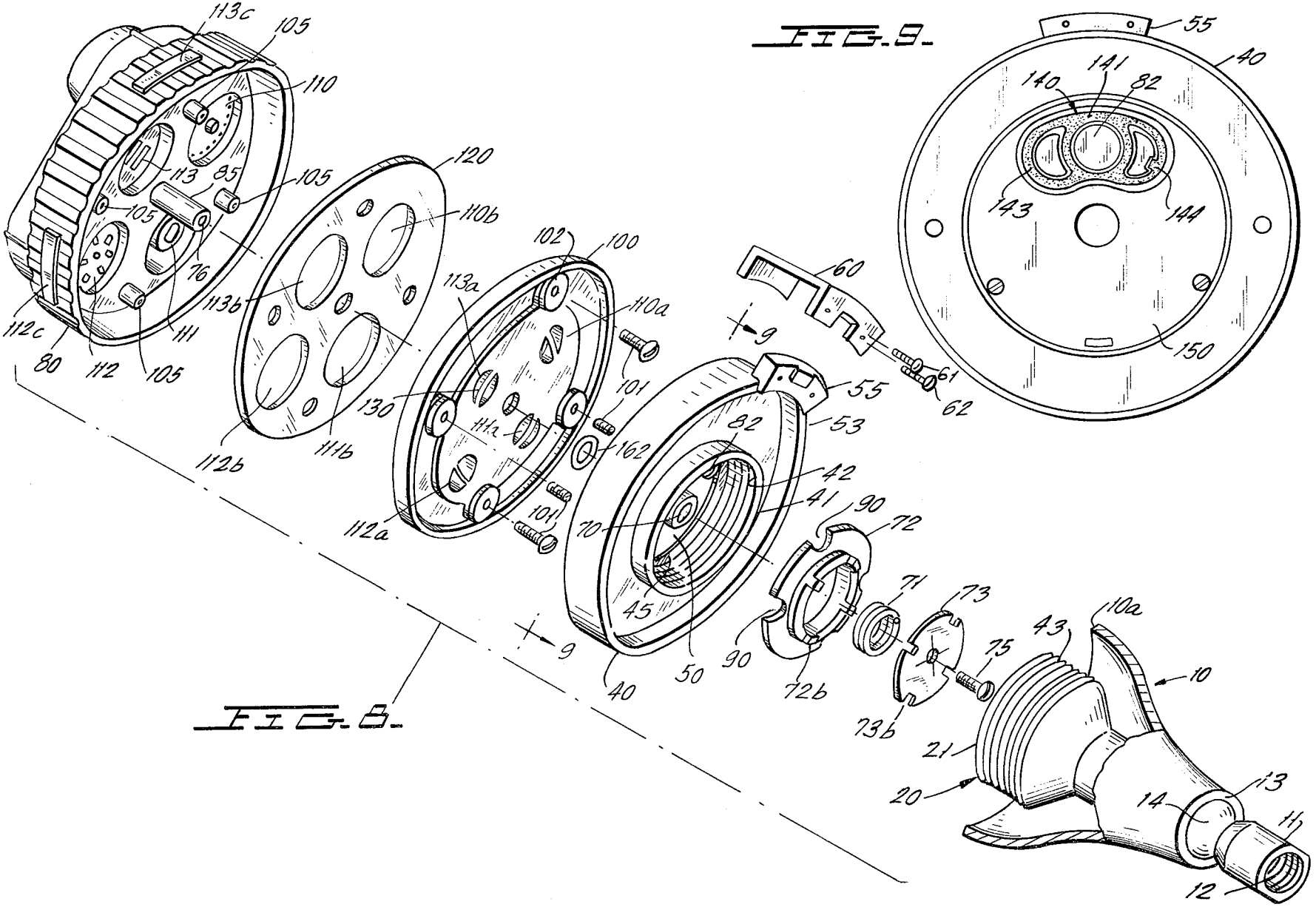
FIG. 8 is an exploded view in perspective showing the various parts of the shower head of the present inventin.
FIG. 9 is a view taken from line 9 of FIG. 8 looking in the direction of the arrows.

Referring to the drawings, it should be pointed out that the operation and the novel elements of the shower head of the present invention are more particularly apparent in the exploded perspective view of FIG. 8. The description herein will be directed primarily to FIG. 8. The other Figures may be referred to where required to show the relationship of the parts.

The casing 10 is basically a cosmetic shroud which provides an ornamental exterior appearance and also cooperates in supporting the fitting or bracket 11 which may be secured by the internal threads 12 to the threaded pipe extension or outlet in the structure to which the shower head is to be secured.

The upper end 13 of the casing 10 is open to receive the integral ball swivel 14 of the fitting 11. As may be seen from FIG. 4, this upper end 13 is sufficiently conical to provide a bearing for the ball 14 of fitting 11. The ball 14 is retained in the casing 10 by the holder 20 which consists (see also FIG. 4) of a main section 21 which supports all of the control elements of the shower head. Main section 21 includes a frusto-conical section 22 that is integrally connected at its wider bottom end to the almost cylindrical section 21 and at its narrower end to a threaded end 23 which is received in the internal threads 24 at the top of the casing 10.

The threaded section 23 of the holder 20 is provided with an opening 25 registering with the end 26 of the longitudinal opening 27 in fitting 11 so that when the holder 20 is in place a bearing is provided for the ball swivel 14 of the fitting 11 to hold the ball 14 in place in the casing 10.

Since no leakage is desired past the ball, an O-ring 30 is provided at the seat of the ball 14 at the top threaded section 23 of the holder 20 so that the water will enter directly into the interior of the holder 20 and not leak out past the upper section of the casing 10 either back out through the top or down alongside of the holder 20 to the lower portion 10a of the casing 10.

A housing 40 is provided at the lower end of the holder 20. The housing 40 has an upward projecting cylindrical extension 41 which is internally threaded at 42. The cylindrical section 21 of the holder 20 is externally threaded at 43. The holder 20 is secured into the housing 40 so that the threads 42, 43 interengage to integrate the housing 40 with the holder 20. An O-ring 45 at the bottom of the section 21 of the holder 20 is positioned between the housing 40 and the lower end of the section 21 of the holder to prevent leakage into the outer casing 10 and out either through the top of the casing or at the margins at **10*a*** of the casing.

Figure 1:
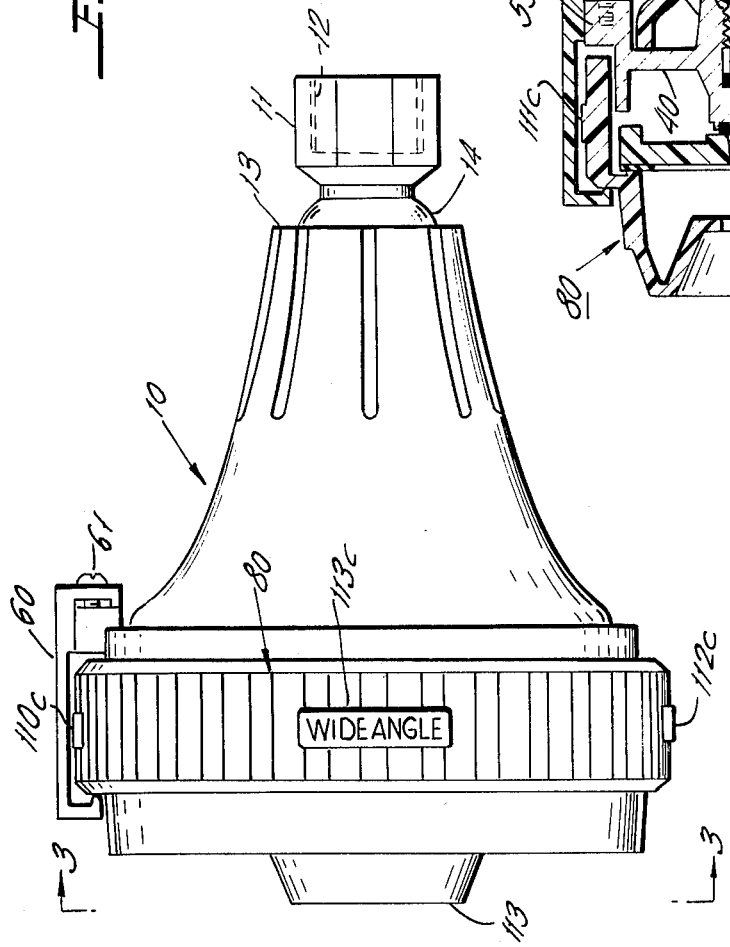
FIG. 1 is a side view of the novel shower head of the present invention.
Figure 7:
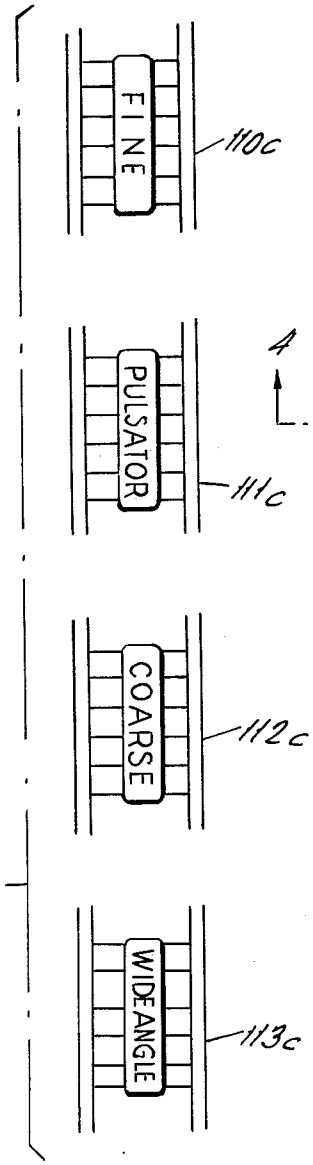
FIG. 7 is a developed view of the circular perimeter of the novel shower head of the present invention showing the indicia marked thereon.
Figure 6:
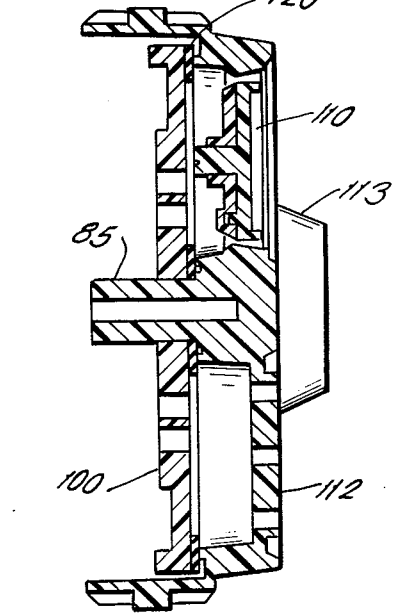
FIG. 6 is a cross-sectional view taken from line 6—6 of FIG. 3 looking in the direction of the arrows.

The housing 40 has a bottom flat plate 50 normal to the cylindrical extension 41 of the housing and extending beyond extension 41 to an additional cylindrical wall 53. Wall 53 is provided with an additional short arcuate extension 55 to which a plate 60, preferably transparent and carrying an appropriate lubber line, may be attached, in any suitable manner, as by the screws 61, 62, to register with the portion of the device carrying the nozzles and thereby indicate which nozzle is in position for operation (see FIGS. 1 and 7) as hereinafter described.

The central wall 50 is provided with a bearing 70 around which may be placed a compression spring 71 and the support disc or separator 72 and over which the washer 73 may be placed. The bearing 70 permits the screw 75 to pass therethrough and to enter into a threaded section 76 of the below described nozzle section 80.

The wall 50 is also provided with an opening 82 therethrough. This is the only opening in the wall 50 and hence the only means of passage of water from the fitting 11 through the holder 20 and the housing 40 to the nozzle section 80.

The nozzle section 80 is provided with the upwardly extending bushing 85, which extends through the bearing 70 of the housing 40 and is rotatable therein. When the screw 75 is tightened, it causes the support disc or separator 72 to seat directly against the wall 50 with the spring 71 and the washer 73 providing backlash protection with respect to the screw 75 and holding it in place. The support disc or separator 72 is thus integrated with the nozzle carrier 80 and rotates therewith.

The support disc or separator 72 bears tightly, and as a seal, against the base plate 50 of housing 40. The support disc 72 is provided with a plurality of peripheral recesses 90, only one of which is registered at any one time with the opening 82 in the housing 40. The recesses 90 in support disc 72 function as hereinafter described. Each is permanently in registry with one of the nozzles and the respective outlets 110–113 leading thereto. By being tightened down against the pressure of spring 71, the separator not only prevents leakage behind the wall 50 but also acts as an important support for wall 50 of housing 40 and plate 110 which is connected thereto to prevent any slight tilt of wall 50 which might result in providing a leakage path fron one nozzle to the next.

There is a set plate 100 positioned next to the housing 40. The nozzle carrier 80 is integrated with the set plate 100 by a plurality of screws 101 which enter through the openings 102 in the set plate 100 and then enter into the threaded interior of the upstanding bushings 105 of the nozzle plate 80.

Figure 3:
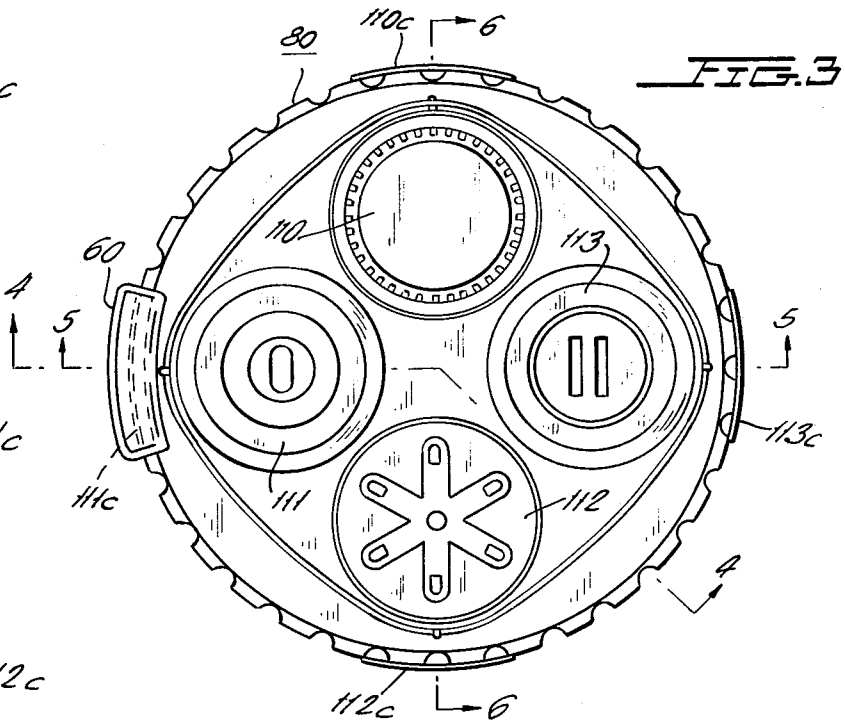
FIG. 3 is a bottom view of the novel shower head of the present invention.
Figure 5:
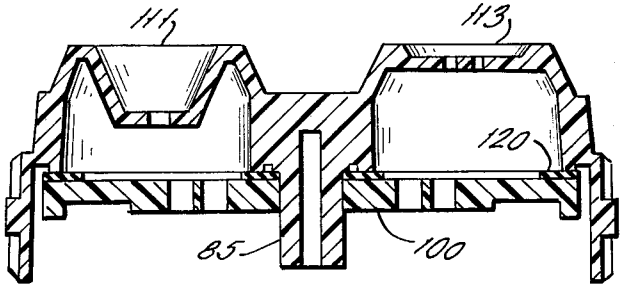
FIG. 5 is a cross-sectional view taken from line 5—5 of FIG. 3 looking in the direction of the arrows.

As will be obvious from FIG. 8 as well as from FIG. 3, the nozzle carrier 80 is provided with, in this case, four different nozzles, 110, 111, 112, 113, each spaced radially at the same distance from center and in separate quadrants. The set plate 100 is provided with corresponding openings 110*a*, 111*a*, 112*a*, 113*a* which register exactly with the nozzles 110–113 owing to the fact that the screws 101 and elements 102 and 105 cooperate to position the set plate 100 and the nozzle plate 80 so that they are essentially integrated for purposes of operation.

A packing disc 120 is captured between the set plate 100 and the nozzle carrier 80 when the screws 101 are tightened in position. The packing disc 120 is provided with openings 110*b* to 113*b* corresponding to the nozzles and in registry with the respective nozzles and the respective openings 110*a* to 113*a* of the set plate. The packing disc 120 is a resilient member preferably of neoprene and so arranged that, when the screws 101 are tightened, lateral communication from one nozzle to the other is positively prevented.

The packing disc 120 acts in combination with the support disc 72 which supports the base wall 50 of the housing 40 against any tilt, to prevent any undesired transfer of fluid from one nozzle passage to another nozzle passage.

The periphry of the nozzle plate 80 has appropriate legends (see FIG. 7) which will register with the lubber line on the member 60 to indicate to the user which nozzle is in position.

The cross members 130 in the openings 110*a* to 113*a* help distribute the flow across each entire nozzle.

In assembly of the device, the packing disc 120 is first laid into the nozzle carrier 80 and the set plate 110 is then laid down on the packing disc 120 with the openings 110*a*–113*a* of the set plate and the openings 110*b* to 113*b* of the packing disc 120 and the nozzle sections 110–113 all in registry. The housing 40 is then inserted so that the bushing 85 thereof passes through the bearing 70 of the housing. The spring 71 is then inserted over the bearing 70 and the support disc or separator 72 is placed around the spring so that one of the sectors 90 in the separator 72 registers exactly with the opening 82 in the base of the housing. The screw 75 is then inserted through the washer 73 and past the spring 71, support disc 72 and into the bushing 85 in the bearing 70 and tightened down to the position shown in FIG. 4. This integrates the separator 72 with the nozzle section 8. The washers 73 may even have indentations 73*a* which will bear on the upper surface of bushing 85 extending through the bearing 70 to interconnect washer 73 with the bushing 85. The notches 73*b* of the washer 73 engage lugs 72*b* of separator 72 to ensure that support disc 72 will rotate with the nozzle housing 80.

It will be seen at this point that the nozzle carrier 80 and its packing disc 120, set plate 100 and the separator 72 can be rotated with respect to the housing 40 merely by grasping the knurled exterior of the nozzle carrier 80 and turning the same with respect to the housing 40.

Figure 2:
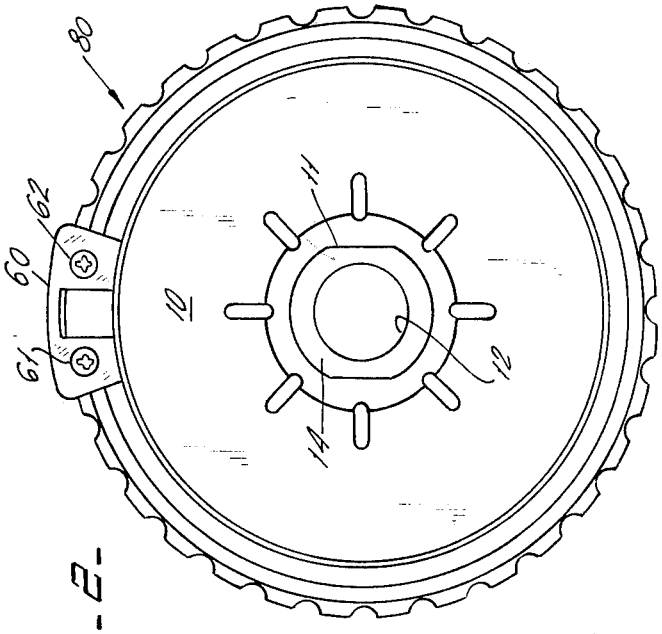
FIG. 2 is a top view of the novel shower head of the present invention.
Figure 4:
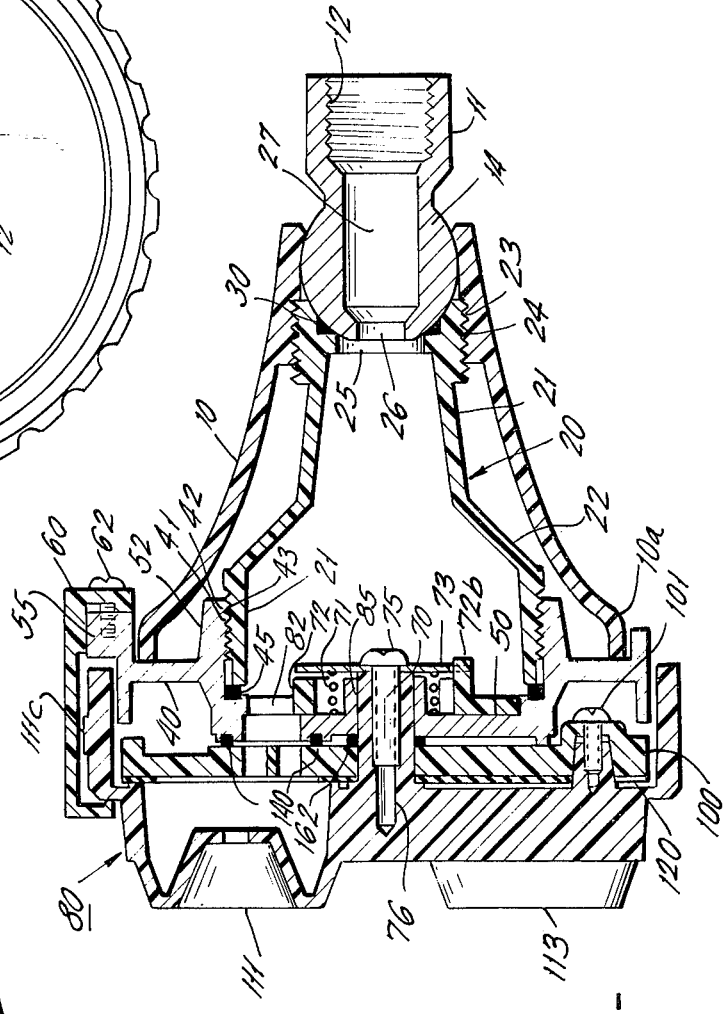
FIG. 4 is a cross-sectional view taken from line 4—4 of FIG. 3 looking in the direction of the arrows.

When all of these devices have thus been integrated, then the threaded section 43 of the end 21 of the holder 20 is threaded into the threaded section 42 of the housing 40 and the entire device is integrated, as shown in FIG. 4.

Since all of the water which is to pass through any of the openings passes through opening 82 in the housing 40, this opening 82 will register successively with the openings 110*a*–113*a* in the set plate 100 as the nozzle plate 80 is rotated. To prevent transverse leakage at opening 82, the bottom wall (see FIG. 9) of the housing 40 is provided with a gasketing structure 140 consisting of a main body 141 surrounding the opening 82 and peripheral retaining rings 143, 144 integral with the section 141. The base or bottom 150 of the housing 40 is extended and shaped to provide appropriate recesses as shown in FIG. 9 to receive the main section 141 of the gasket 140 and the positioning and holding rings 143, 144 of the gasket 140. This ensures that there will be no transverse leakage from the particular opening 110*a*–113*a* which is in registry with the opening 82 laterally to any of the other openings.

It will of course be obvious that additional sources of leakage out of the casing are avoided by appropriate placing of gasketing material such as the O-rings 160, 161, 162 (FIG. 4) between the set plate and the nozzle carrier 80 with which it is integrated.

The shower head is mounted on the shower outlet by means of the fitting 11. The shower head casing 10 is universally supported on the ball swivel 14 since the ball is captured by the upper end 23 of the holder 20. Thus the shower head may be tilted to any desired angle. Thereafter the water will exit only through the selected nozzle which is aligned with the indicator or lubber line on the element 60. Water will not escape from the shower head in any undesired path owing to the various gasketing elements which have been provided including the O-rings 30, 45, 160, 161 and 162, and will not escape laterally within the shower head to activate any nozzle which is not desired owing to the existence of the packing disc 120, the separator and support member 72 and the additional packing or gasketing material 140 at the base 150 of the housing plate 40.

Once the shower head is installed the user may rotate the nozzle carrier to any desired setting secure in the knowledge that water will escape only through the nozzle selected and not through any other nozzle and will not be transferred internally to any other nozzle and will not escape laterally and uselessly outside the shower head through any other path that might otherwise be provided for the water.

In the foregoing the present invention has been described solely in connection with a preferred illustrative embodiment thereof. Since many variations and modifications of this invention will now be obvious to those skilled in the art it is preferred that the scope of the invention be defined not by the specific disclosures herein contained, but only by the appended claims.

The embodiments of the invention in which an exclusive privilege or property is claimed are defined as follows:

1. A shower head having a plurality of nozzles and comprising:

a holder;

an axial water flow passage through said holder;

a housing secured to said holder and having a wall transverse to said axial water flow passage;

a nozzle section rotatably mounted on said housing and having a nozzle section wall parallel to said housing wall, said nozzle section having a plurality of nozzles each radially spaced at the same distance from the center of rotation of said nozzle section with respect to said housing;

said housing wall having a water passage opening similarly radially spaced from the said center of rotation of the nozzle section with respect to said housing;

said nozzle section being rotatable to successively register one nozzle at a time with said water passage opening in said housing wall, and a support disc bearing against said housing wall on the side thereof opposite the side on which said nozzle section is secured, said support disc being connected to and rotatable with said nozzle section, said support disc maintaining said nozzle section and housing wall parallel to each other and in contact with each other to prevent transverse leakage at the housing wall.

2. The shower head of claim 1 in which the housing wall has a central bearing, the nozzle section has a central bushing extending through said bearing;

and means securing said support disc to said bushing of said nozzle section for rotation therewith.

3. The shower head of claim 2 in which said means for securing said support disc to said bearing comprises a washer secured to said bearing, means on said water engaging said bushing, and means on said washer engaging said separator.

4. The shower head of claim 3 in which a spring is compressed between said washer and said housing wall and the means securing said washer to said bearing comprises a screw.

5. The shower head of claim 1 wherein a casing is provided and said holder is secured in said casing at the end opposite said housing.

6. The shower head of claim 5 wherein the end of the casing at which said holder is secured carries a mounting fitting including a part spherical member with a water passage opening therethrough;

said holder and casing cooperating to frictionally capture said part spherical member to permit rotation of the shower head thereabout.

7. The shower head of claim 1 wherein said water passage opening in said housing wall is surrounded by a water-excluding gasket to prevent transverse flow of water parallel to said housing wall and to confine the passage of water to the nozzle in registry therewith.

8. The shower head of claim 7 wherein the nozzle section comprises in combination a plate carrying the plurality of nozzles and a set-plate having a plurality of openings in registry with the nozzles and secured to the nozzle carrying plate, and a resilient disc having a plurality of openings in registry with the nozzles and set-plate openings, said resilient disc being captured and compressed between said set-plate and said nozzle carrying plate.

9. The shower head of claim 1 wherein said housing is provided with a peripheral indicator which is stationary on said housing;

and said rotatable nozzle section is provided with a plurality of peripheral indicia each corresponding to one of the nozzles and successively registrable with said housing indictor as the nozzle section is rotated with respect to said housing.

10. The shower head of claim 1 wherein said support disc is provided with a plurality of peripheral notches each in registry with a nozzle and successively registrable with said water-passage opening in said housing wall as said nozzle section is rotated.

* * * * *